US007930846B2

(12) United States Patent
Barnard

(10) Patent No.: US 7,930,846 B2
(45) Date of Patent: Apr. 26, 2011

(54) INSPECTION WALLET

(75) Inventor: Russell Barnard, Sandbach (GB)

(73) Assignee: SG World Limited, Crewe (GB)

( * ) Notice: Subject to any disclaimer, the term of this patent is extended or adjusted under 35 U.S.C. 154(b) by 442 days.

(21) Appl. No.: 11/845,643

(22) Filed: Aug. 27, 2007

(65) Prior Publication Data

US 2008/0066836 A1 Mar. 20, 2008

(51) Int. Cl.
*G09F 21/04* (2006.01)

(52) U.S. Cl. ..... 40/643; 40/649; 40/654.01; 40/661; 40/661.08

(58) Field of Classification Search ..... 40/643, 40/644, 649, 654.01, 661, 661.08
See application file for complete search history.

(56) References Cited

U.S. PATENT DOCUMENTS

| | | | | |
|---|---|---|---|---|
| 1,633,724 | A * | 6/1927 | Burris | 224/563 |
| 2,176,535 | A * | 10/1939 | Markoff | 40/124.06 |
| 2,681,814 | A | 6/1954 | Johnson | |
| 3,655,119 | A * | 4/1972 | Thompson | 229/72 |
| 4,462,175 | A * | 7/1984 | Romberger | 40/1 |
| 4,465,305 | A * | 8/1984 | Bateman et al. | 281/31 |
| 4,781,379 | A * | 11/1988 | Parks | 273/148 R |
| 4,850,614 | A | 7/1989 | Shanahan et al. | |
| 5,431,207 | A | 7/1995 | Siegel | |
| 6,058,638 | A * | 5/2000 | Slåttebrekk | 40/654.01 |
| 6,453,589 | B1 * | 9/2002 | Schwartz | 40/359 |
| 6,539,653 | B1 * | 4/2003 | Finke | 40/124.06 |
| 6,601,622 | B1 | 8/2003 | Young | |
| 6,886,283 | B2 * | 5/2005 | Arraut | 40/661 |
| 2004/0016163 | A1 | 1/2004 | Lansing | |
| 2008/0067177 | A1 * | 3/2008 | Cormack | 220/507 |
| 2008/0276513 | A1 * | 11/2008 | Jose et al. | 40/654.01 |

FOREIGN PATENT DOCUMENTS

| | | |
|---|---|---|
| EP | 1142503 | 10/2001 |
| FR | 2631481 A | 11/1989 |
| GB | 2381513 | 7/2003 |
| JP | 8113090 | 5/1996 |

OTHER PUBLICATIONS

Koob, Michael, EP Search Report for EP 07253132, Aug. 3, 2009.

* cited by examiner

*Primary Examiner* — Gary C Hoge
(74) *Attorney, Agent, or Firm* — Chernoff, Vilhauer, McClung & Stenzel

(57) ABSTRACT

A inspection wallet in the form of a paddle comprising a sleeve to define a front pocket and a rear pocket, the front pocket having a window and the rear pocket retaining a book of inspection insets having a status side, the inserts foldable for inserting into the front pocket across a divide in the status side and having an alternative message either side of the divide to enable each message to be shown through the window, the inserts having a counterfoil in the book consistent with a reverse side to the status side to provide a record of inspection.

20 Claims, 3 Drawing Sheets

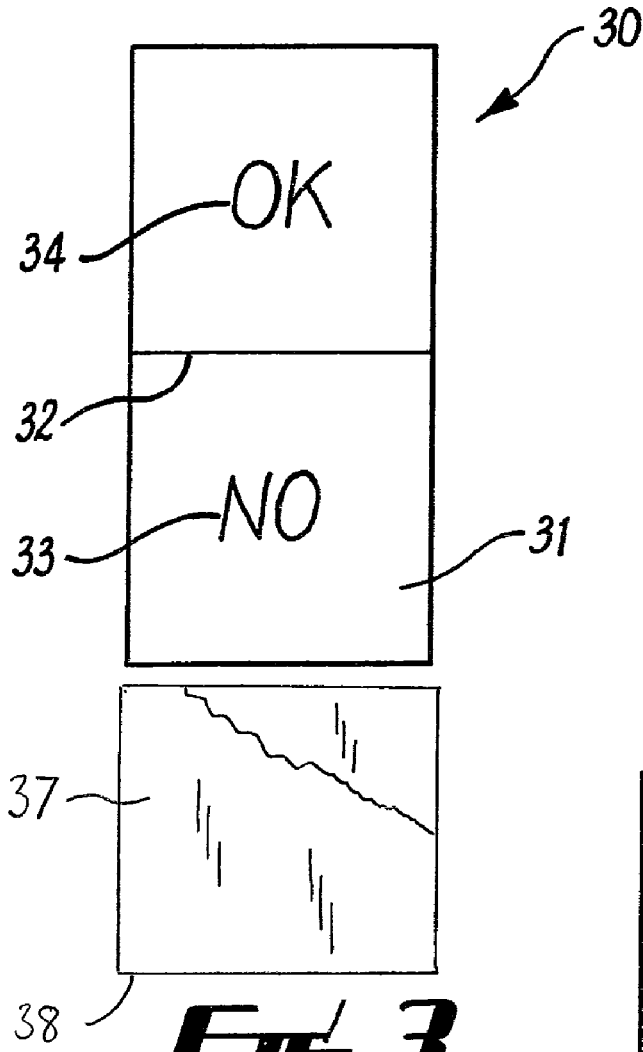
FIG. 3
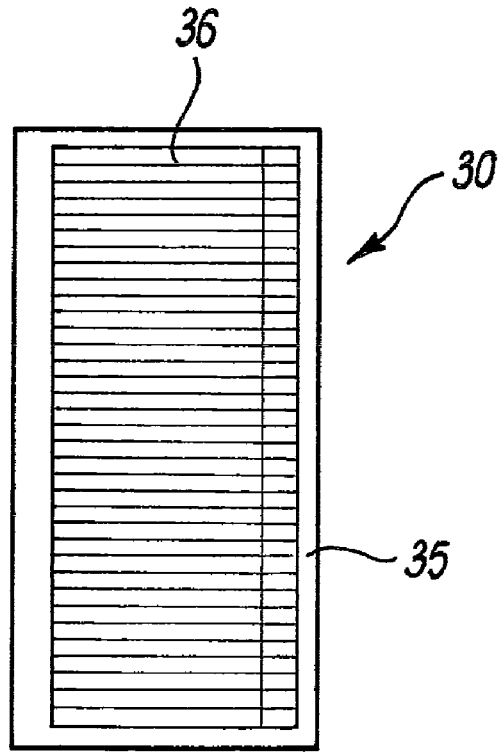

INSPECTION WALLET

CROSS REFERENCE TO RELATED APPLICATION

This application claims priority under 35 USC 119 of United Kingdom Patent Application No. 0618246.3 filed Sep. 16, 2006.

The present invention relates to inspection wallets and more particularly to inspection wallets utilised with regard to such equipment as forklift trucks to provide both a ready indication as to the acceptability of that forklift truck for operational use as well as convenience with respect to inspection.

It will be appreciated that equipment such as forklift trucks in particular require regular and consistent inspection in order to ensure the forklift truck is safely used. This is in view of the number of potential users of that forklift truck, the potential for the truck to topple and fail in use and that a driver of that truck is exposed to danger. In such circumstances generally a forklift truck is inspected daily and an appropriate status paddle provided which clearly shows whether the truck is available for use or not. These paddles have a highly visible element which indicates whether the truck has passed inspection or not and an associated "inspection book" which highlights the checklist of features on the forklift truck inspected and checked.

Unfortunately, separation of the inspection book and status paddle can lead to mis-placing of the inspection book and therefore failure to understand the reason the equipment is unavailable.

Aspects of the present invention provide a inspection wallet in the form of a paddle comprising a sleeve to define a front pocket and a rear pocket, the front pocket having a window and the rear pocket retaining a book of inspection insets having a status side, the inserts foldable for inserting into the front pocket across a divide in the status side and having an alternative message either side of the divide to enable each message to be shown through the window, the inserts having a counterfoil in the book consistent with a reverse side to the status side to provide a record of inspection.

Typically, the wallet has a default message viewable through the window when an insert is not located within the front pocket. Generally, the default message is located upon a surface of the rear pocket.

Generally, the inspection wallet has mountings to allow resilient location of the wallet upon a forklift truck.

Possibly, the front pocket has a reciprocal shape to a folded insert to appropriately present a folded insert in use.

Typically, the rear pocket has a shape consistent with a part of the book to appropriately present the book with a part of the book exposed for retrieval.

Possibly, the front pocket and the rear pocket are of the same side of the wallet.

Possibly, the wallet comprises a sheet material having an elongate rectangular shape with a rear pocket flap folded along a side edge and a front pocket flap folded along a bottom edge with at least one weld seam to hold the rear pocket flap and the front pocket flap in place. Generally, the side edge and the bottom edge are substantially perpendicular to each other.

Generally, the bottom edge has apertures to facilitate folding and/or drainage.

Possibly, the side edge includes cut outs for consistency with the apertures.

Generally, the sheet material is a plastics material.

Possibly, the wallet is reinforced where the front pocket and the rear pocket overlay each other. Generally, the book reinforces the wallet as a snug fit within the rear pocket in order that the wallet remains substantially flat.

Also in accordance with aspects of the present invention there is provided a method of forming an inspection paddle comprising forming a wallet essentially as a flat sheet cut to define a rectangular shape back portion with a front pocket flap along a bottom fold line and a rear pocket flap along a side fold line, folding the front pocket flap and the rear pocket flap into engagement with the back portion along with the respective bottom fold line and the rear fold line and securing these rear fold flap and the front pocket flap to define a rear pocket and a front pocket, providing a book for insertion within the rear pocket in order to reinforce the wallet to define a forklift truck inspection paddle having a substantially flat configuration.

Generally, the front pocket flap and the rear pocket flap are secured by welds or adhesive.

Possibly, the method includes providing apertures in the bottom fold line. Possibly, the method includes providing reciprocal cut outs to the apertures in the side fold line.

Normally, the method includes forming a window in the front pocket flap.

Preferably, the insert is located within a transparent liner to be located within the front pocket. Typically, the liner facilitates insertion of the insert within the front pocket. Generally, the liner incorporates a seal along an insertion end.

Typically, the material is polypropylene.

Embodiments of the present invention will now be described by way of example and with reference to the accompanying drawings in which:

FIG. 3 illustrates the alternate sides of an insert.

Confirmation that equipment such as a forklift truck is suitable for use is important and, as indicated above, is generally performed daily or at the start of a shift by the driver of the truck. The inspection notice confirmation is generally referred to as a paddle and clearly must be robust in order to ensure consistent presentation. As indicated, generally at the beginning of each shift the driver, operator or inspector will perform an inspection as outlined on a check list within an "inspection book" record for that particular equipment. If the equipment passes the inspection an inspection paddle attached to the equipment will be updated and the inspection book located for safety and typically within an office or other record system. In such circumstances it will be appreciated there is a significant possibility of mislaying the appropriate inspection book for the equipment or the wrong book being used for inspection. Nevertheless, provision of a robust substantially flat paddle type indicator of equipment status has advantages. For illustration purposes reference to a fork lift truck as the inspected equipment is provided. However, it will be understood that other equipment and machinery can also have an inspection paddle/wallet in accordance with aspects of the present invention applied to them. Such equipment and machinery includes machine tools, construction plant and access platforms.

In accordance with aspects of the present invention an inspection wallet to be utilised as an indicator paddle is provided comprising a base or back substantially of rectangular section upon which a rear pocket and a front pocket are provided. The rear pocket is shaped to allow insertion of a snugly fit book comprising a number of inserts. These inserts on one side include a list of inspection points for the forklift truck and on the other side a status indicator comprising alternate messages either side of a divide. The divide is substantially in the middle to allow the insert to be folded. In the folded state the insert is then placed with the appropriate message uppermost in a front pocket. This front pocket normally incorporates a window to allow the message to be viewed. Furthermore, generally, the insert is placed within a lining or sleeve to provide some weather and environmental protection for the insert. In the above circumstances it will be appreciated that the wallet in accordance with aspects of the present invention generally comprises a folded sheet forming the front pocket and the rear pocket appropriately sized in order to respectively receive an insert in a flat configuration for ease of viewing and a book to enter the wallet for convenient storage as well as to provide reinforcement to the wallet in order to have sufficient strength to present a substantially flat robust paddle for securing to the forklift truck.

Figure 1:
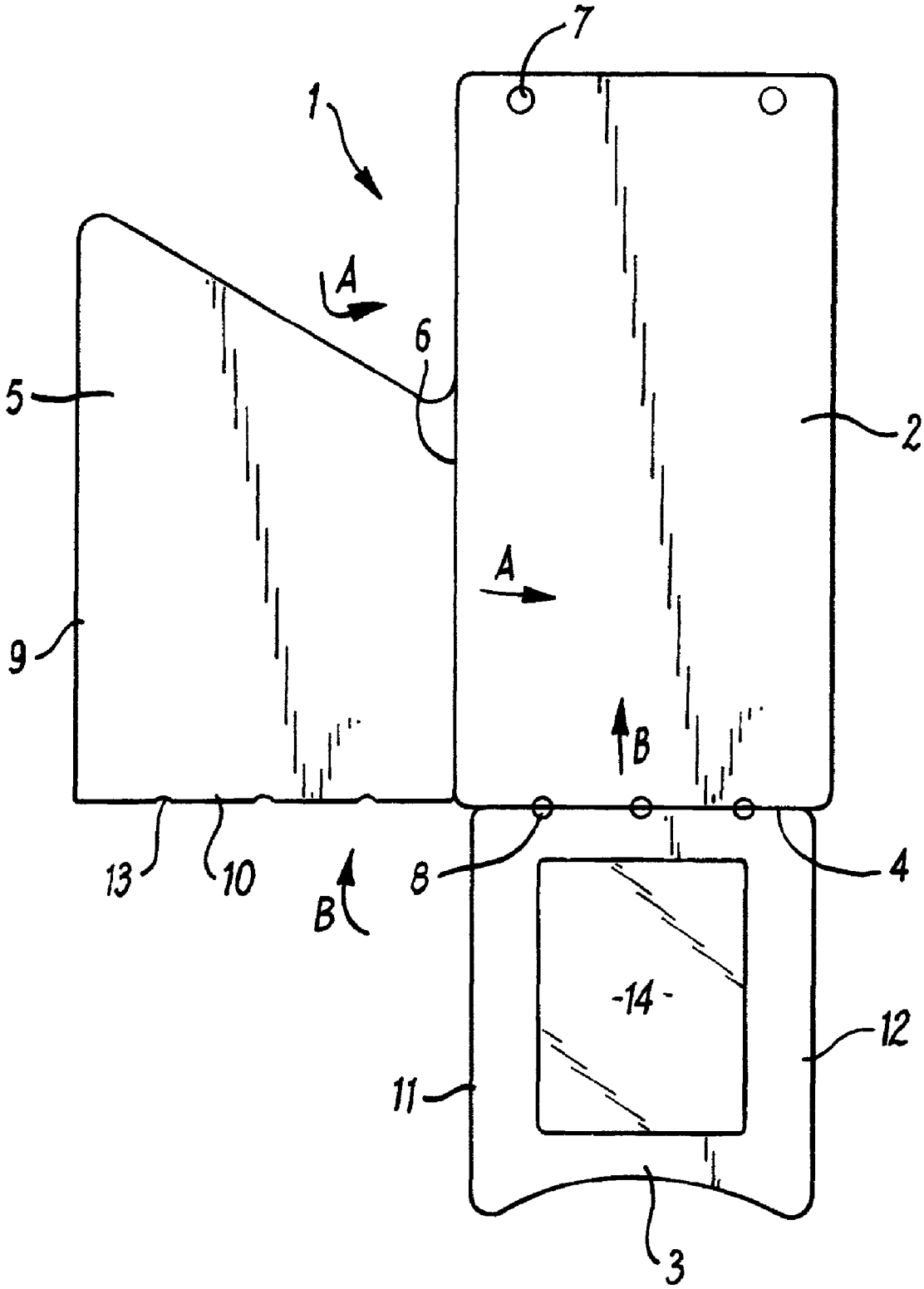
FIG. 1 is a plan view of an inspection wallet to form an inspection paddle.

FIG. 1 provides a plan view of a wallet in accordance with aspects of the present invention which will form an inspection paddle for securing to a forklift truck. As can be seen, the wallet comprises a relatively flat sheet material cut to define a base or back portion 2 which is arranged to have a front pocket flap 3 secured along a bottom edge 4 and a rear pocket flap 5 secured along part of a side edge 6. It will be appreciated that the edges 4, 6 represent fold lines for the flaps 3, 5 in order to define the front pocket and the rear pocket in accordance with aspects of the present invention. The base or back portion 2 incorporates apertures or other mountings 7 to enable the wallet to be secured to an appropriate part of a forklift truck. Such securing will typically be through a tie grip.

The wallet 1 will normally be formed from an appropriate sheet material such as a plastics material and in particular polypropylene of a gauge to allow folding along the edges 4, 6. The sheet from which the wallet 1 is formed will be relatively flexible and tough such that it is suitable for the typical operational conditions to which a forklift truck is exposed. It will also be understood that the material from which the wallet is formed may be arranged to allow operation at relatively low temperatures such as where a forklift is operated in a cold store.

Achieving a sufficiently robust paddle like structure from the wallet 1 is important therefore, as indicated, the overlapping flaps 3, 5 will add some reinforcement to the wallet 1. However, as indicated, and as will be described later, the book of inserts will be located within the rear pocket 5 in order to further reinforce the wallet to achieve acceptable robustness in use.

In order to facilitate insertion of the book as well as the inserts along with, where required drainage, the bottom edge 4 will incorporate apertures 8 which will improve the degree of flexibility and fold range about the edge 4. It will be understood that generally the rear pocket 5 will be folded first into contact with the base or back portion 2 and then the front pocket 3 folded over that rear pocket flap 5. In such circumstances the rear pocket is initially folded across the side edge 6 in the direction of arrowhead A and then the front pocket flap 3 folded in the direction of arrowhead B in order to create the wallet in accordance with aspects of the present invention. Generally, the flap 5 will extend substantially across the width of the base or back portion 2 such that an edge 9 is secured to that portion 2. A bottom edge 10 of the flap 5 will normally not be secured to provide some flexibility and range to enable the book to be inserted in the rear pocket when formed. The front pocket flap 3 as indicated will be turned about a fold created at the bottom edge 4 and then secured along the edges 11, 12. Thus, the bottom edge 4 provides a closure to the open edge 10 of the rear pocket flap 5 such that a book located within the rear pocket formed by the flap 5 will not fold over. It will be noted that the edge 10 of the flap 5 incorporates cut outs 13 which are generally consistent with parts of the apertures 8. As indicated such an arrangement allows for air flow such that insertion of books etc., will be more readily achievable but also provides for an alignment guide when securing the edges 9, 11, 12 together.

In the above circumstances it will be appreciated that the method of forming the wallet of the present invention comprises cutting a sheet material as indicated in the shape depicted in FIG. 1 with a base or back portion 2 and with a front pocket flap 3 and a rear pocket flap 5. The flaps 3, 5 are then folded and pressed along the edges 4, 6 and secured appropriately along the edges 9, 11, 12. Such securing may be through adhesive or more normally a weld of some description. Once the wallet is constructed a book is then located within the rear pocket to provide reinforcement. This book as indicated comprises a number of insert leaves with each insert again foldable for insertion when required within the front pocket formed by the flap 3. It will be noted that the front flap 3 incorporates a window 14 to allow the insert to be viewed.

Figure 2:
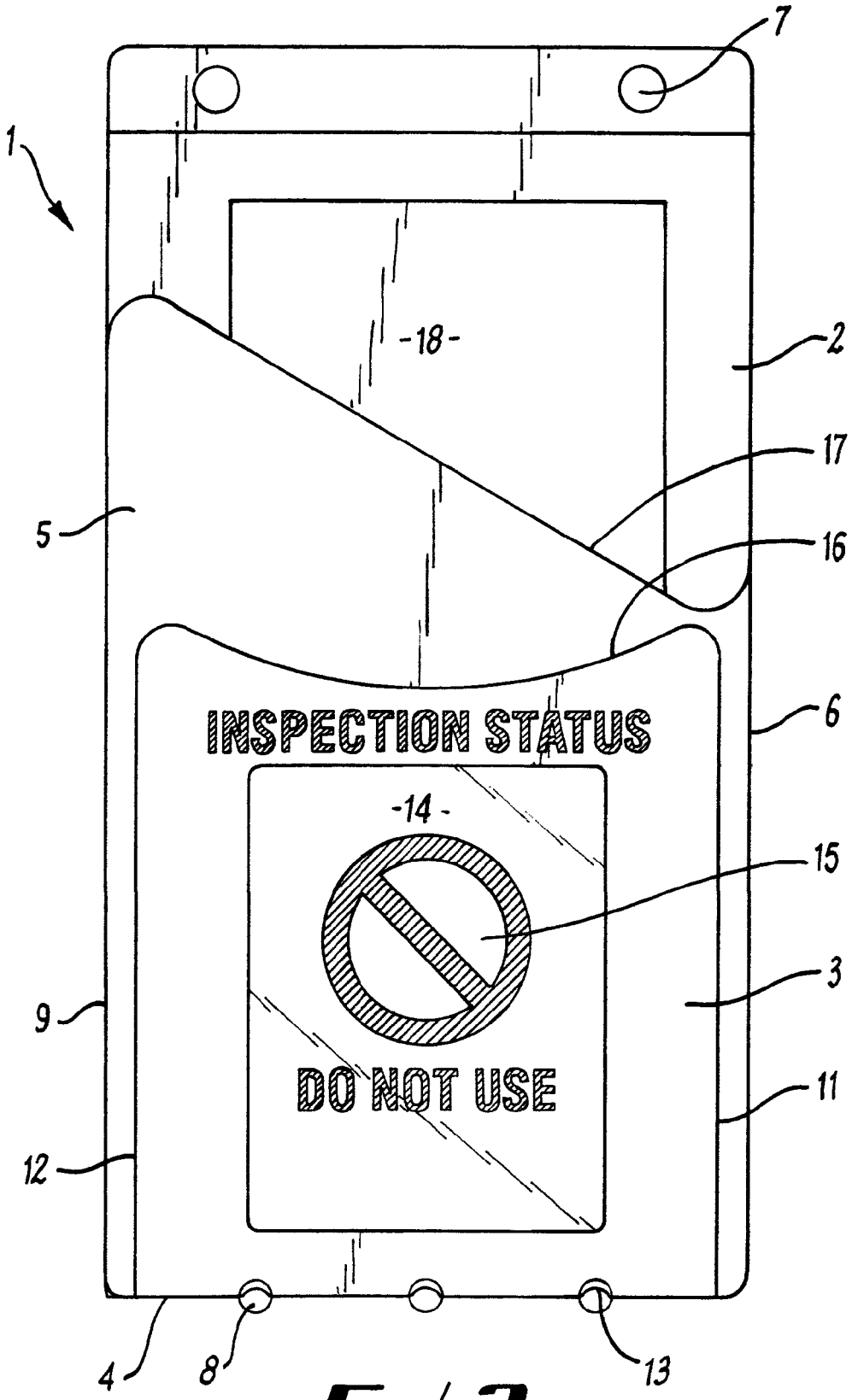
FIG. 2 is a plan view of an inspection wallet to form an inspection paddle in accordance with aspects of the present invention.

FIG. 2 illustrates the wallet 1 as depicted in FIG. 1. Thus, the wallet 1 has a front pocket 3 and a rear pocket 5 formed on a base or back portion 2 such that a window 14 can allow presentation of an insert to indicate the inspection status. An insert is not located within the front pocket 3 in the depiction illustrated in FIG. 2 and it will be noted that a default message 15 is provided to show status. This default message 15 will be viewed when no inspection has taken place, that is to say upon initial installation of the wallet 1 as a forklift truck paddle indicator or whilst an inspection takes place. As can be seen, the rear flap 5 is secured along an edge 9 to the base or back portion 2 whilst the front flap portion 3 is secured along edges 11, 12. Top edges 16, 17 are appropriately shaped to enable insertion of the insert respectively in the front pocket 3 and a book 18 within the rear pocket 5. This book 18, as indicated previously, comprises a number of leaves in the form of tear off inserts for the front pocket 3. The book 18 reinforces the wallet 1 in order to create a substantially flat robust plaque or paddle for association through the mountings 7 with a forklift truck. The rear pocket 5 is shaped to ensure that with the book 18 located within the pocket 5 a relatively flat but robust presentation surface is created to ensure that an insert located within the front pocket 3 is clearly displayed. It will be appreciated that such presentation is important in order to ensure that the inspection status can be easily seen on a plaque like paddle.

The front pocket 3 as indicated includes a window 14 such that an insert removed from the book 18 can be laid flat within the pocket 3 for presentation through the window.

FIG. 3 illustrates the alternate sides of an insert 30 in accordance with aspects of the present invention. On a status side 31 the surface is divided by a divide 32 between alternate messages 33, 34. In such circumstances it will be appreciated that the insert 30 can be folded along the divide 32 and then through appropriate dimensioning that insert 30 placed within the front pocket to show the alternate message 33, 34 dependent upon whether inspection has been passed. In such circumstances the messages 33, 34 depict inspection status. FIG. 3 also illustrates a transparent liner 37 to be located within the front pocket. The liner facilitates insertion of the insert 30 within the front pocket. The liner 37 incorporates a seal 38 along an insertion end of the liner. On a rear side 35 of the insert 30 an inspection check list 36 is presented as an aide memoir to remind the inspector, that is to say the driver, as to the functions which must be checked upon an inspection. This rear side will generally be uppermost in the book 18 to allow ease of running through the check list before the insert 30 is torn from the book 18 for folding, as appropriate, and then inserted into the front pocket. In such circumstances the insert placed within the front pocket shows an inspection status by one or the other of the messages 33, 34 and an appropriate maintenance engineer can then retrieve a message to indicate the repair problem with the forklift truck by reviewing the inspection side 35. In such circumstances repair or maintenance can be performed so that the fork lift truck can be re-inspected or the maintenance engineer can switch to the appropriate message shown by inverting the insert 30 within the front pocket 3 as required.

As indicated above, the book 18 inserted in the rear pocket will add reinforcement to the wallet to provide an adequate flap reinforcement paddle for utilisation with respect to a forklift truck. In accordance with aspects of the present invention the book will comprise counterfoil elements retained after removal of the inserts 30. These counterfoils will incorporate copier paper consistent with the inspection check list 30 such that a maintenance record is maintained within the book 18. In the above circumstances as indicated the insert 30 located within the front pocket shows inspection status through the window 14 and by reviewing the check list on the rear of that insert confirmation that all inspection functions have been provided or if an inspection has been failed the reason for that failure such that a maintenance engineer can then readily see by a visual inspection those forklift trucks which require maintenance and can retrieve the inserts to determine the repair/maintenance task required to bring the forklift truck to operational level. The book 18 maintains an ongoing maintenance/inspection history of the forklift truck and because it is associated with a wallet 1 and is therefore part of the inspection paddle for that forklift is less likely to be lost. It will be understood that by providing counterfoils between the book 18 and the insert 30 the maintenance engineer does not need to view the book 18 when identifying the tasks to be performed in repair.

It will also be understood as indicated that the book 18 comprises a number of inserts. In such circumstances the inspection checklist 30 can also be the same or sequenced as required for particular maintenance programmes. In such circumstances, as indicated, daily inspections are required of certain check points but should a forklift truck require periodic maintenance checks over and above the normal daily checks or lubrication servicing etc., an inspection checklist 36 may incorporate such additional requirements or indication that lubrication is required etc., and therefore inherently the inspection will be failed such that the appropriate message 33 can be inserted in the front pocket by the inspector and the side 30 utilised by the maintenance engineer to perform the desired tasks.

Modifications and alterations to the embodiments of the present invention described above will be envisaged by those skilled in the art. Thus, as indicated, typically the wallet will be made from a plastics material such as polypropylene but it will also be understood parts of the paddle and in particular the base or back portion could be made from other materials including wood or metal.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A inspection wallet in the form of a paddle comprising a sleeve of sheet material having an elongate rectangular shape with a rear pocket flap folded along a side edge to define a rear pocket and a front pocket flap folded along a bottom edge to define a front pocket, at least one weld seam to hold the rear pocket flap and front pocket flap in place, the front pocket having a window and the rear pocket retaining a book of inspection inserts having a status side, the inserts foldable for inserting into the front pocket across a divide in the status side and having an alternative message either side of the divide to enable each message to be shown through the window, the inserts having a counterfoil in the book consistent with a reverse side to the status side to provide a record of inspection, a default message being viewable through the window when an insert is not located within the front pocket.

2. A wallet as claimed in claim 1 wherein the default message is located upon a surface of the rear pocket.

3. A wallet as claimed in claims 1 wherein the inspection wallet has mountings to allow resilient location of the wallet upon a forklift truck.

4. A wallet as claimed in claim 1 wherein the front pocket has a reciprocal shape to a folded insert to appropriately present a folded insert in use.

5. A wallet as claimed in claim 1 wherein the rear pocket has a shape consistent with a part of the book to appropriately present the book with a part of the book exposed for retrieval.

6. A wallet as claimed in claim 1 wherein the front pocket and the rear pocket are of the same side of the wallet.

7. A wallet as claimed in claim 1 wherein the side edge and the bottom edge are substantially perpendicular to each other.

8. A wallet as claimed in claim 1 wherein the bottom edge has apertures to facilitate folding and/or drainage.

9. A wallet as claimed in claim 8 wherein a bottom edge of the rear pocket flap includes cut outs for consistency with the apertures.

10. A wallet as claimed in claim 1 wherein the sheet material is a plastics material.

11. A wallet as claimed in claim 1 wherein the wallet is reinforced where the front pocket and the rear pocket overlay each other.

12. A wallet as claimed in claim 1 wherein the book reinforces the wallet as a snug fit within the rear pocket in order that the wallet remains substantially flat.

13. A method of forming an inspection paddle comprising forming a wallet essentially as a flat sheet cut to define a rectangular shape back portion with a front pocket flap along a bottom fold line and a rear pocket flap along a side fold line, folding the front pocket flap and the rear pocket flap into engagement with the back portion along the respective bottom fold line and the side fold line and securing the rear pocket flap and the front pocket flap to define a rear pocket and a front pocket, providing a book for insertion within the rear pocket in order to reinforce the wallet to define a forklift truck inspection paddle having a substantially flat configuration.

14. A method as claimed in claim 13 wherein the front pocket flap and the rear pocket flap are secured by welds or adhesive.

15. A method as claimed in claim 13 wherein the method includes providing apertures in the bottom fold line.

16. A method as claimed in claim 15 wherein the method includes providing reciprocal cut outs to the apertures in a bottom edge of the rear pocket flap.

17. A method as claimed in claim 15 wherein the method includes forming a window in the front pocket flap.

18. A method as claimed in claim 17 wherein the book is located within a transparent liner then located within the front pocket.

19. A method as claimed in claim 18 wherein the book is used to facilitate insertion of the insert within the front pocket.

20. A method as claimed in claim 18 wherein the liner incorporates a seal along an insertion end.

* * * * *

UNITED STATES PATENT AND TRADEMARK OFFICE

CERTIFICATE OF CORRECTION

PATENT NO. : 7,930,846 B2
APPLICATION NO. : 11/845643
DATED : April 26, 2011
INVENTOR(S) : Russell Barnard It is certified that error appears in the above-identified patent and that said Letters Patent is hereby corrected as shown below:

Cover sheet, left column, between items (22) and (65) should be
--(33) Foreign Priority Data: United Kingdom GB 0618246.3 filed September 16, 2006--

Column 6, line 35 (Claim 9, line 1) “claim 8” should be --claim 1--

Signed and Sealed this
Twenty-first Day of June, 2011

David J. Kappos

David J. Kappos
*Director of the United States Patent and Trademark Office*